US005434741A

United States Patent [19]

Mulkins et al.

[11] Patent Number: 5,434,741

[45] Date of Patent: Jul. 18, 1995

[54] CONSUMABLE SEMICONDUCTOR IGNITER PLUG

[75] Inventors: George F. Mulkins, Brooksville; Tom L. Rothenbuhler, Jacksonville Beach; John E. Sohnly, Jacksonville, all of Fla.

[73] Assignee: Unison Industries Limited Partnership, Jacksonville, Fla.

[21] Appl. No.: 153,576

[22] Filed: Nov. 16, 1993

[51] Int. Cl.[6] ..... H01T 13/20

[52] U.S. Cl. ..... 361/253; 313/141; 123/169 EA

[58] Field of Search ..... 313/11.5, 118, 125, 313/126, 137, 141, 142, 143, 144, 145; 361/212, 247, 253; 123/143 R, 169 R, 169 EL, 169 EA

[56] References Cited

U.S. PATENT DOCUMENTS

| | | | |
|---|---|---|---|
| 3,745,400 | 7/1973 | Meyer | 313/144 |
| 3,882,338 | 5/1975 | Meyer . | |
| 4,390,738 | 1/1982 | Mulkins et al. | 361/253 |
| 4,764,703 | 8/1988 | Meyer . | |
| 4,952,837 | 8/1990 | Matsumura et al. | 313/135 |
| 4,973,877 | 11/1990 | Suzuki et al. | 313/131 |
| 4,980,601 | 12/1990 | Aoki et al. | 313/143 |
| 5,103,136 | 4/1992 | Suzuki et al. | 315/59 |

*Primary Examiner*—Jeffrey A. Gaffin

*Attorney, Agent, or Firm*—Leydig, Voit & Mayer, Ltd.

[57] ABSTRACT

An apparatus and method extends the useful life of a low tension igniter plug by advancing a homogeneous semiconductor element as it is consumed over time by sparks between a central conductor and an outer metal shell of the plug. An insulator surrounds at least a portion of the central conductor, with the outer metal shell having a discharge end spaced to provide a spark gap with a tip of the central conductor. The homogeneous semiconductor element surrounds the tip of the central conductor and is axially positioned between the insulator and the discharge end of the outer metal shell so that it is in contact with the outer metal shell at the spark gap. As the semiconductor element is consumed over time by recurring electrical sparks at the spark gap, the homogeneous semiconductor element is advanced towards the spark gap so that a portion of the semiconductor element is continuously maintained at the spark gap and available for consumption by the electrical sparks until substantially all of the semiconductor element is consumed, thereby extending the useful life of the igniter plug.

12 Claims, 2 Drawing Sheets

CONSUMABLE SEMICONDUCTOR IGNITER PLUG

FIELD OF THE INVENTION

The present invention relates to igniter plugs for igniting fuel in engines, and more particularly, to a method and apparatus for extending the useful life of such igniter plugs.

BACKGROUND OF THE INVENTION

Low tension igniter plugs for igniting fuel in gas engines have certain advantages over high tension igniter plugs, the foremost being increased system reliability since a significantly lower voltage is necessary to induce an electrical spark in low tension igniter plugs. However, low tension igniter plugs suffer a serious disadvantage over high tension igniter plugs, that being a much shorter useful life. Typically, conventional low tension igniter plugs maintain only approximately one-quarter to one-third of the life of high tension igniter plugs. As a result, the primary reason for not utilizing low tension systems on commercial engines has been the absence of a low tension igniter with a useful life equivalent to that of a high tension igniter.

In a conventional low tension ignition system, the useful life of the igniter plugs is generally limited by the amount of semiconductor material provided between the plug's central electrode and its outer metal electrode. Typically, the semiconductor material is coaxially disposed between the shell and the central conductor at the spark gap existing between the shell and the tip of the central conductor. In all types of igniter plugs, it is of considerable importance to maintain the spark at or very near the end of the igniter plug. However, in the conventional low tension igniter, the semiconductor element is permanently fixed in place. Consequently, as the semiconductor material nearest the tip is consumed, the surface of the semiconductor material recedes away from the tip such that the igniter eventually will fail to spark, or the spark will become recessed and fail to project into the combustion zone. Accordingly, this type of construction results in a limited useful life for the igniter plug.

Several techniques have been developed in the past for solving various problems associated with igniter plugs, but none have addressed the problems discussed above relating to the relatively short life of low tension igniter plugs. For example, U.S. Pat. No. 3,882,338 to Meyer discloses an igniter plug that includes a biasing arrangement acting upon an insulator separating the central electrode from the outer metal shell of the igniter plug. This biasing arrangement includes at least one spring which compensates for thermal contraction and expansion of the insulator so that the insulator is maintained in pressure contact with the surface of the outer electrode. This technique overcame problems associated with insulators that were rigidly mounted between the two electrodes often resulting in cracking of the insulator and eventual igniter failure due to thermal expansion and contraction. However, because the Meyer '338 patent is directed to high tension igniter plugs which do not utilize a semiconductor material, it does not address problems associated with consumption of the semiconductor material in low tension igniters resulting in variations in the spark plasma pattern and ultimately a shorter useful life.

SUMMARY OF THE INVENTION

In view of the foregoing, it is the primary object of the present invention to provide a method and apparatus for extending the useful life of low tension igniter plugs.

In that regard, it is another object of the present invention to continuously maintain the spark plasma pattern at or very near the end of the igniter plug in the area of the spark gap throughout the entire life of the igniter.

It is a further object of this invention to provide an igniter plug which achieves substantially uniform consumption of the semiconductor material associated with the igniter plug.

Still another object of this invention is to provide a method and apparatus which includes extra "replacement" semiconductor material that feeds forward as the semiconductor material is consumed to replenish the tip, thereby increasing the useful life of the igniter plug.

These and other objects are accomplished in accordance with the present invention by providing an igniter plug which advances the semiconductor material as it is consumed by an electrical spark so that a portion of the semiconductor material is continuously available for consumption by the spark, thereby extending the useful life of the igniter plug. The igniter plug includes a tubular outer metal shell, a central conductor extending axially through the outer metal shell, and an insulator surrounding at least a portion of the central conductor, with the outer metal shell having a discharge end arranged to provide a spark gap with an electrode at the discharge end of the central conductor. A homogeneous semiconductor element is provided which surrounds the discharge end of the central conductor and is axially disposed between the insulator and the discharge end of the outer metal shell so that it is in contact with the outer metal shell at the spark gap. Because the semiconductor element is consumed by the electrical spark over time, the semiconductor element is advanced towards the spark gap in such a way that the electrical spark occurs at substantially the same position relative to the spark gap throughout the life of the igniter plug until substantially all of the semiconductor element is consumed.

DETAILED DESCRIPTION OF THE PREFERRED EMBODIMENT

While the invention will be described in connection with a preferred embodiment, there is no intent to limit the invention to this embodiment. On the contrary, the intent is to cover all alternatives, modifications, and equivalents included within the spirit and scope of the invention as defined by the appended claims.

Figure 1:
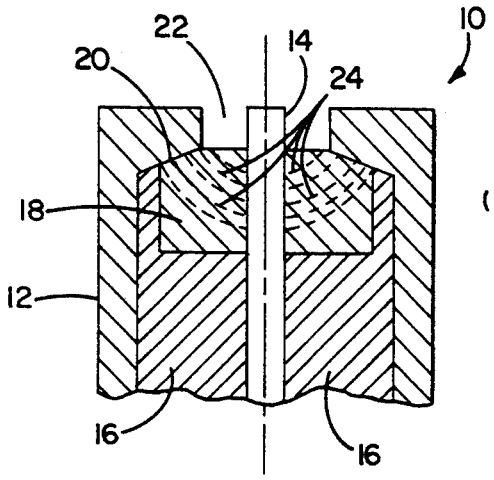
FIG. 1 (PRIOR ART)
FIG. 1 is an exploded cross-sectional view of a conventional low tension igniter plug.

As mentioned above, the useful life of conventional low tension igniter plugs is limited by the amount of semiconductor material available for consumption by an electrical spark. Because of their shorter useful life, such low tension igniter plugs have not been widely accepted for use on commercial engines. FIG. 1 is an exploded cross-sectional diagram of the spark discharge end of a conventional low tension igniter plug 10. The igniter plug 10 includes an outer metal shell 12 serving as an outer electrode, and a central conductor 14 extending axially through the outer shell 12. An insulator 16 is positioned between the outer shell 12 and the central conductor 14 and extends laterally to the end of outer shell 12 so that a semiconductor element 18 is in contact with outer shell 12 at essentially only one surface generally identified by reference numeral 20. Semiconductor element 18 provides a relatively low resistance electrical path between outer shell 12 and central conductor 14 so that a lower voltage can be utilized to induce an electrical spark. Importantly, this contact surface 20 is near a spark gap 22 which exists between the tip of central conductor 14 and the end of outer shell 12. Throughout the life of the igniter plug, however, the semiconductor element 18 is consumed by the electrical spark in such a way that the semiconductor material becomes recessed with respect to the spark gap 22. As depicted in FIG. 1, reference numeral 24 designates a series of increasingly recessed dashed lines which represents the wear pattern of the semiconductor element 18 over time. As the consumption continues over time, the electrical spark becomes recessed into the cavity behind spark gap 22. As a result, the igniter plug will fail to project a spark into the combustion zone, effectively ending the life of the igniter plug. In other words, the spark plasma pattern relative to the gas turbine engine changes to such an extent that the igniter plug fails. It is quite apparent that a significant amount of semiconductor material is still left unconsumed by the igniter plug in this conventional low tension igniter plug.

Figure 2:
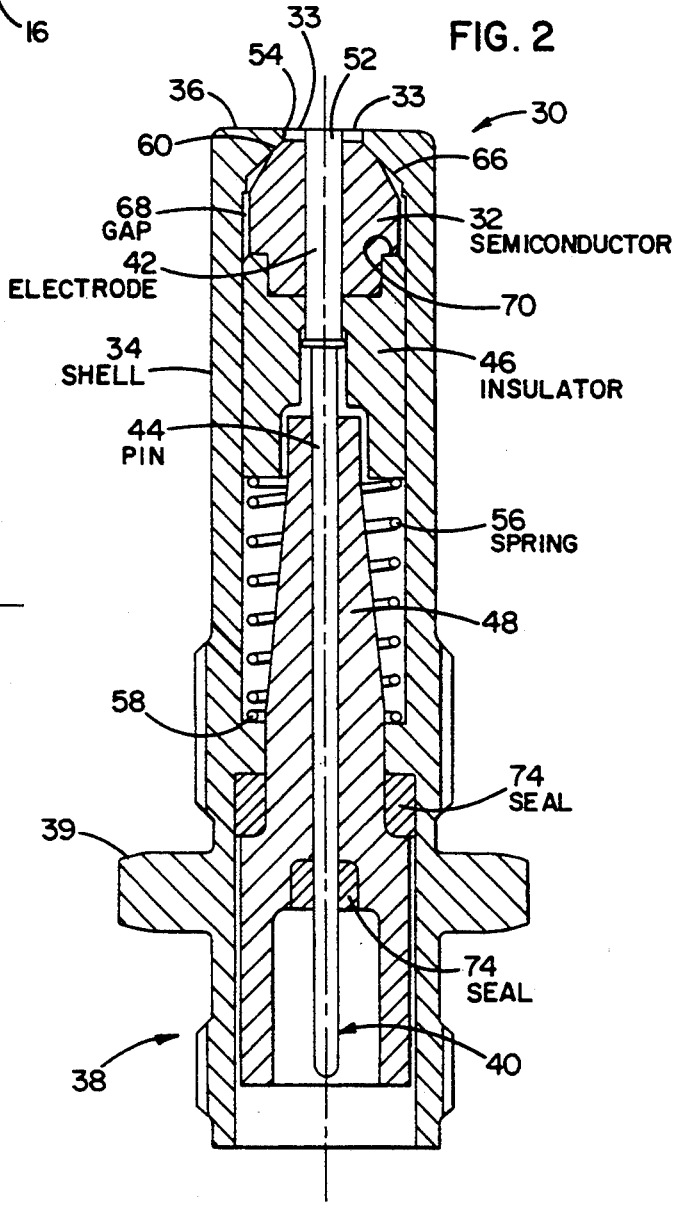
FIG. 2 is a cross-sectional diagram of an improved low tension igniter plug according to the present invention.

In accordance with the present invention, an improved low tension igniter plug 30 in FIG. 2 has a useful life comparable to that of high tension igniter plugs. The igniter plug 30 includes an arrangement for advancing a semiconductor element 32 as it is consumed by an electrical spark so that a portion of the semiconductor element 32 is continuously available at the spark gap 33. By providing this arrangement, the electrical spark occurs at substantially the same position relative to the spark gap 33 throughout the life of the igniter plug, thereby extending the useful life of the igniter plug 30 far beyond that of conventional low tension igniter plugs.

As with conventional igniter plugs, the low tension igniter plug 30 of the present invention includes a tubular outer metal shell 34 having a discharge end 36 providing a spark discharge, and a connector portion 38 including a mounting flange 39 for mounting the igniter plug 30 in an engine. A central conductor 40 extends axially through the outer shell 34, and includes a discharge end 42 serving as a central electrode for inducing an arc discharge with the outer shell 34. As shown in FIG. 2, the central conductor 40 is composed of two portions including the electrode portion 42 and a cylindrical pin 44. In the preferred embodiment, the electrode 42 is made of pridium while the pin 44 is composed of a less expensive material such as KOVAR, an iron-nickel-cobalt alloy commonly described by standards AMS 7727 and ASTM F15. However, it should be understood that the entire central conductor 40 could be a single rod composed of the same material as the central electrode 42. Igniter plug 30 also includes an insulator formed in two sections including a sliding forward insulator 46 and a rear insulator 48. As shown, the rear insulator portion 48 originates at the connector end 38 of igniter plug 30 and extends axially through the outer shell 34 until it telescopically engages the forward insulator 46. Semiconductor element 32 is positioned between the forward insulator 46 and the discharge end 36 of outer shell 34 so that it is near the spark gap 33 lying between a tip 52 of central electrode 42 and spark discharge portion 54 of outer shell 34.

In accordance with the preferred embodiment of the present invention, the arrangement for advancing the semiconductor element 32 includes a spring 56 for feeding the semiconductor element 32 as it is consumed over time by recurring electrical sparks at the spark gap 33. The spring 56 is positioned between the sliding forward insulator 46 and a shoulder 58 of the outer shell 34. In keeping with the invention, as the semiconductor material is consumed by the recurring electrical sparks, the spring 56 continually feeds the semiconductor element 32 toward the spark gap 33 so that the material near the spark gap 33 is replenished with fresh material until substantially all of the semiconductor material is consumed. Thus, in a new igniter as shown in FIG. 2, the spring 56 is in its most compressed position which forces the insulator 46 and the semiconductor element 32 forward as the semiconductor material is consumed. This arrangement ensures that the semiconductor element 32 maintains an area of contact 60 with outer shell 34.

In keeping with an important aspect of the present invention, the semiconductor element 32 must be formed of a homogeneous semiconductor material. Unlike some conventional igniter plugs that provide a relatively thin semiconductor coating on an insulator, semiconductor element 32 is formed of a homogeneous semiconductor material so that the portion of the semiconductor element 32 which is continuously maintained near the spark gap 33 will always have the same composition. Importantly, the homogeneous semiconductor element 32 is composed of a substantially greater amount of semiconductor material than is typically provided in conventional low tension igniter plugs, which, along with the feeding arrangement of the igniter plug 30, serves to significantly extend the useful life of the igniter plug 30 over conventional low tension igniter plugs. It should be appreciated that any homogeneous semiconductor material known in the industry and to those skilled in the art can be utilized for the semiconductor element 32.

Figure 3:
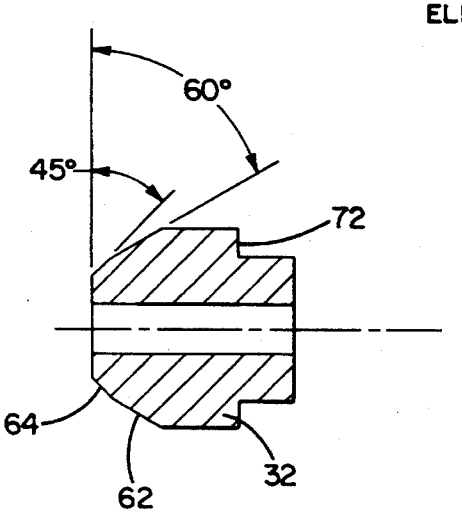
FIG. 3 is an exploded view of the semiconductor element in the igniter plug shown in FIG. 2.

The semiconductor element 32 is depicted in greater detail in FIG. 3, which is an exploded cross-sectional view of the element. In order to allow semiconductor element 32 to properly advance forward towards spark gap 33 as it is consumed by an electrical spark, the element includes a bevel arrangement at its forward portion. As best shown in FIG. 3, semiconductor element 32 includes two bevels having different angles, with a first bevel 62 aligned at a 60° angle relative to the discharge end of igniter plug 30, and a second bevel 64 lying at a 45° angle.

To complement the bevels 62 and 64 of the semiconductor element 32, the outer shell 34 also includes a bevel 66 at its discharge end 36. Bevel 66 lies at a 45° angle with respect to the longitudinal axis of igniter plug 30, such that when the igniter plug is new, the second bevel 64 of semiconductor element 32 lies in direct contact with outer shell 34 at contact area 60, while the 60° bevel 62 is not in contact with outer shell 34. The second bevel 64 in semiconductor element 32 provides a good initial seating for the semiconductor element 32 and ensures that the element initially rests at a specific point relative to the discharge end 36 of igniter plug 30, while the first bevel 62 ensures proper feeding of semiconductor element 32 as it is consumed. It should be appreciated, however, that it is not necessary to provide two bevels 62 and 64 in semiconductor element 32 as is shown in connection with the preferred embodiment of the present invention. Instead, in keeping with the present invention, because the primary concern is advancing the semiconductor element 32 as it is consumed, the semiconductor element 32 must include at least one bevel (such as bevel 62) which is of a steeper angle than a complementary bevel in the outer shell 34 (such as bevel 66). As explained in connection with FIGS. 4A–4C below, this complementary bevel arrangement ensures that semiconductor element 32 advances toward the spark gap 33 under the application of force supplied by spring 56 as the semiconductor material is consumed.

Due to the relative dimensions of semiconductor element 32 and outer metal shell 34, as shown in FIG. 2, a gap 68 exists between semiconductor element 32 and outer shell 34 extending from the forward insulator 46 to the contact area 60. Gap 68 is an important aspect of the igniter plug arrangement, since an insulator is not provided to fully surround the semiconductor element as in the conventional igniter plug that is shown in FIG. 1. Instead, in FIG. 2, semiconductor element 32 is seated on and is of a lesser diameter than forward insulator 46. Referring to FIG. 2 in connection with FIG. 3, insulator 46 includes a shoulder 70 upon which rests a slot 72 of semiconductor element 32. Thus, gap 68 effectively serves as an insulator since it prevents electrical current from passing through any other portion of semiconductor element 32 except for that portion which is in contact with outer shell 34 at contact point 60.

The igniter plug 30 as shown in FIG. 2 also includes a plurality of seals 74 located at the connector end 38 of the igniter plug which isolate the ambient environments of the connector and discharge ends of the plug. The ambient environments at each end are at severely different pressures such that a large differential pressure is present between the discharge and connector ends 36 and 38 of igniter plug 30 when it is in use. While the construction of the connector end 38 is essentially unimportant to the present invention, it should be appreciated that the seals 74 must be located behind the moving parts of the feed mechanism (i.e., spring 56, insulator 46 and semiconductor element 32). Some conventional igniter plugs in which the insulator and semiconductor are permanently fixed in place also use that area for the primary seals. Consequently, this conventional construction precludes the use of spring feed or movable portions. However, with the present invention, by providing the seals 74 at the connector end 38 of igniter plug 30, it is possible to provide the movable arrangement for advancing the semiconductor element 32 as it is consumed so that substantially all of the semiconductor material is utilized.

While the preferred embodiment of the present invention utilizes a spring 56 such as a helical spring, other feeding arrangements can be utilized for advancing the semiconductor element 32 in accordance with the present invention. For example, the thermal expansion and contraction of the semiconductor material can be used in conjunction with a speed nut for forcing the semiconductor material forward as it is consumed. Under this ratchet-type arrangement, when the semiconductor material is heated, the speed nut forces the material forward depending upon the amount of consumption, and when the semiconductor material cools, the speed nut maintains the semiconductor material at its forward position. Alternatively, the combustor bypass air pressure can be utilized to feed the semiconductor element forward, or a conical spring washer can be used.

Figure 4A:
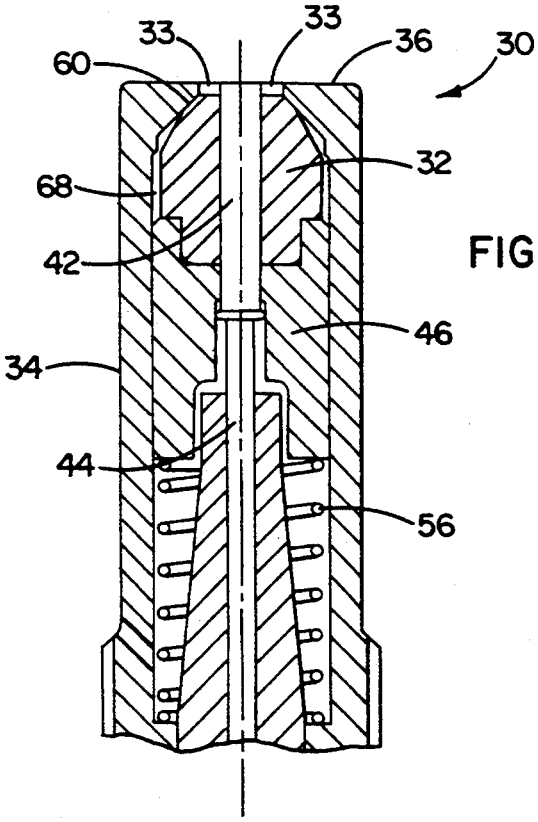
FIG. 4A is a partial cross-sectional diagram of the igniter plug of the present invention in a new condition.
Figure 4B:
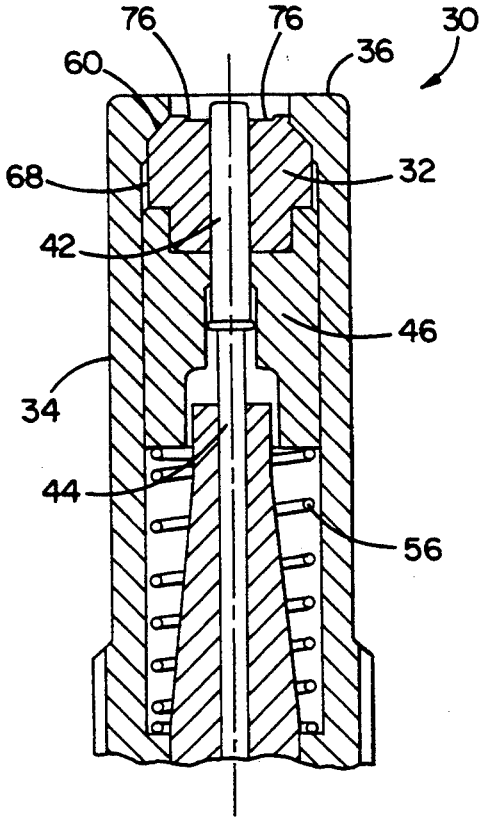
FIG. 4B is a partial cross-sectional diagram of the igniter plug of the present invention in an intermediate wear condition.
Figure 4C:
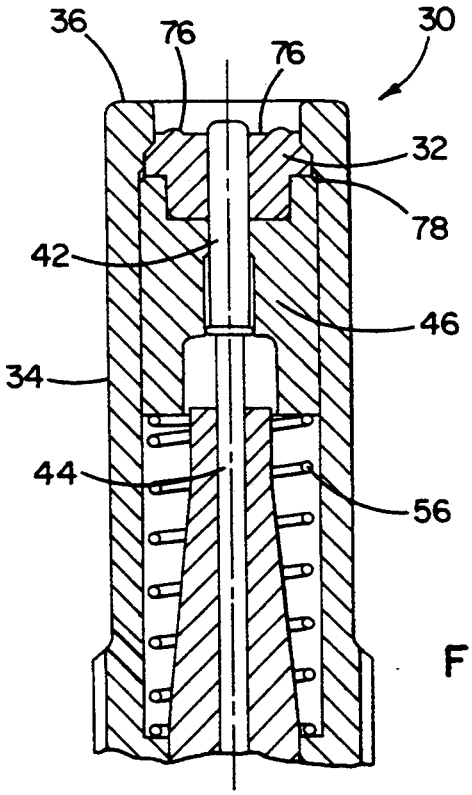
FIG. 4C is a cross-sectional diagram of the igniter plug of the present invention similar to FIGS. 4A and 4B but shown in an end-of-life condition.

In order to better visualize the advancing or feeding of the homogeneous semiconductor element 32 as it is consumed by an electrical spark over time, FIGS. 4A, 4B and 4C show the igniter plug 30 of the present invention in new, intermediate wear, and end-of-life conditions, respectively. As can be seen, FIG. 4A is substantially identical to the igniter plug 30 as shown in FIG. 2 and discussed in detail above. Referring next to FIG. 4B, as illustrated with reference numeral 76, a significant amount of the semiconductor element 32 has been consumed by the recurring electrical sparks. However, in accordance with the present invention, the spring 56 has forced the insulator 46 and the semiconductor element 32 forward towards the spark gap 33 as the semiconductor element 32 has been consumed. A close comparison between FIG. 4A and FIG. 4B shows that in the intermediate wear condition, spring 56 has extended beyond its original fully compressed position when the igniter plug is new. Thus, by advancing the semiconductor element 32 as it is consumed, the spark plasma pattern relative to the gas turbine engine is maintained at substantially the same position throughout the life of the igniter plug so that the electrical spark does not become overly recessed with respect to the spark gap 33.

Referring now to FIG. 4C which shows igniter plug 30 in an end-of-life condition, nearly all of the semiconductor element 32 has been consumed, but it can be seen that the consumption of the semiconductor material has been substantially uniform throughout the life of the igniter. A comparison of FIG. 4C and FIG. 4B also demonstrates that spring 56 in FIG. 4C is extended beyond the position shown in FIG. 4B. In keeping with an important aspect of the present invention, spring 56 is still under compression for biasing purposes at the end-of-life condition, but the sliding forward insulator 46 engages a notch 78 in outer metal shell 34 which stops the spring 56 from extending so as not to advance the semiconductor element 32 any further. Otherwise, the remaining portion of semiconductor element 32 may be ingested into the combustion chamber of the engine. It should also be noted that while the semiconductor element 32 is consumed over time by an electrical spark, erosion also occurs in the central conductor 40 at the tip of electrode 42 and at the discharge end 36 of igniter plug 30. However, the igniter plug of the present invention is still capable of maintaining a point of contact between the semiconductor element 32 and the outer metal shell 34 until substantially all of the semiconductor material is consumed by the electrical spark.

As is evident from the foregoing description, the igniter plug of the present invention is an improvement over conventional low tension igniter plugs in that it provides a method for extending the useful life of the igniter plug by advancing the semiconductor material towards the spark gap as it is consumed by an electrical spark over time. This arrangement ensures that a portion of the semiconductor element is continuously available for consumption by the electrical spark until substantially all of the semiconductor element is consumed. By operating in this manner, the electrical spark occurs at substantially the same position relative to the spark gap throughout the life of the igniter plug.

We claim:

1. In an igniter plug having a tubular outer metal shell, a central conductor extending axially through the outer metal shell and an insulator surrounding at least a portion of the central conductor, with the outer metal shell having a discharge end arranged to provide a spark gap with an electrode at a discharge end of the central conductor, a method of extending the useful life of the igniter plug comprising:

providing a homogeneous semiconductor element surrounding the discharge end of the central conductor and axially positioned between the insulator and the discharge end of the outer metal shell so that it is in contact with the outer metal shell at the spark gap, the semiconductor element being consumed by recurring electrical sparks between the electrode of the central conductor and the outer metal shell at the spark gap; and advancing the homogeneous semiconductor element towards the spark gap as it is consumed by the electrical sparks so that a portion of the semiconductor element is continuously maintained at the spark gap and available for consumption by the recurring electrical sparks until substantially all of the semiconductor element is consumed, thereby extending the useful life of the igniter plug.

2. The method according to claim 1 wherein the homogeneous semiconductor element includes at least one bevel having an angle with respect to a longitudinal axis of the igniter plug that is steeper than the angle of a complementary bevel at the discharge end of the outer metal shell.

3. The method according to claim 2 wherein a spring is provided to advance the homogeneous semiconductor element towards the spark gap as it is consumed by the recurring electrical sparks.

4. The method according to claim 2 wherein combustor bypass air pressure is utilized to advance the homogeneous semiconductor element towards the spark gap as it is consumed by the recurring electrical sparks.

5. An improved igniter plug having an extended useful life over conventional igniter plugs, the improved igniter plug comprising, in combination:

an outer metal shell serving as an outer electrode for the igniter plug;

a central electrode extending axially through the outer metal shell, the central electrode having a tip arranged to provide a spark gap with a discharge end of the outer metal shell;

an insulator disposed within the outer shell and surrounding at least a portion of the central electrode;

a homogeneous semiconductor element surrounding the tip of the central electrode and axially disposed between the insulator and the discharge end of the outer metal shell so that it is in contact with the discharge end at the spark gap, the semiconductor element being consumed over time by recurring electrical sparks at the spark gap; and means for advancing the homogeneous semiconductor element towards the spark gap as it is consumed in such a way that a portion of the semiconductor element is continuously available for consumption so that the electrical sparks occur at substantially the same position relative to the spark gap throughout the life of the igniter plug until substantially all of the semiconductor element is consumed.

6. The igniter plug as set forth in claim 5 wherein the homogeneous semiconductor element includes a first bevel having an angle with respect to a longitudinal axis of the igniter plug that is steeper than the angle of a complementary bevel at the discharge end of the outer metal shell.

7. The igniter plug as set forth in claim 6 wherein the homogeneous semiconductor element includes a second bevel axially disposed between the first bevel and the discharge end of the igniter plug, the second bevel having an angle with respect to the longitudinal axis of the igniter plug that is the same as the complementary bevel at the discharge end of the outer metal shell.

8. The igniter plug as set forth in claim 6 wherein the means for advancing comprises a spring.

9. The igniter plug as set forth in claim 6 wherein the means for advancing comprises combustor bypass air pressure exerting force against the homogeneous semiconductor element.

10. An improved igniter plug having an extended useful life over conventional igniter plugs, the improved igniter plug comprising, in combination:

an outer metal shell serving as an outer electrode for the igniter plug, the outer metal shell having a discharge end including an internal bevel;

a central electrode extending axially through the outer metal shell along a longitudinal axis of the igniter plug, the central electrode having a tip arranged to provide a spark gap with the discharge end of the outer metal shell;

an insulator disposed within the outer shell and surrounding at least a portion of the central electrode;

a homogeneous semiconductor element surrounding the tip of the central electrode and axially disposed between the insulator and the discharge end of the outer metal shell so that it is in contact with the discharge end at the spark gap, the semiconductor element including at least one bevel having an angle with respect to the longitudinal axis of the igniter plug that is complementary to and steeper than the angle of the internal bevel at the discharge end of the outer metal shell, and wherein the semiconductor element is consumed over time by recurring electrical sparks at the spark gap; and means for advancing the homogeneous semiconductor element towards the spark gap as it is consumed in such a way that a portion of the semiconductor element is continuously available for consumption so that the electrical sparks occur at substantially the same position relative to the spark gap throughout the life of the igniter plug until substantially all of the semiconductor element is consumed,

11. The igniter plug as set forth in claim 10 wherein the means for advancing comprises a spring.

12. The igniter plug as set forth in claim 10 wherein the means for advancing comprises combustor bypass air pressure exerting force against the homogeneous semiconductor element.

* * * * *